United States Patent [19]

Balz

[11] 4,022,012

[45] May 10, 1977

[54] SURFACE FINISHING MACHINE

[75] Inventor: Gunther W. Balz, Kalamazoo, Mich.

[73] Assignee: Roto-Finish Company, Kalamazoo, Mich.

[22] Filed: Jan. 26, 1976

[21] Appl. No.: 651,400

[52] U.S. Cl. ..... 51/163.2; 51/313

[51] Int. Cl.[2] ..... B24B 31/06

[58] Field of Search ..... 51/7, 163.1, 163.2, 51/164, 313

[56] References Cited

UNITED STATES PATENTS

| | | | |
|---|---|---|---|
| 3,423,884 | 1/1969 | Balz | 51/163.2 |
| 3,490,181 | 1/1970 | Racine | 51/163.2 |
| 3,633,321 | 1/1972 | Balz | 51/163.2 |

FOREIGN PATENTS OR APPLICATIONS

| | | | |
|---|---|---|---|
| 959,849 | 6/1964 | United Kingdom | 51/163.1 |

*Primary Examiner*—Harold D. Whitehead
*Attorney, Agent, or Firm*—Gordon W. Hueschen

[57] ABSTRACT

Parts or workpieces are surface finished in a vibratory finishing chamber with loose finishing material. The parts or group of parts are isolated from each other by part-isolating means which travel with the material in the finishing chamber. The part-isolating means comprise transverse walls maintained in close proximity to the inner surface of the finishing chamber. Means are provided for bringing at least two transverse walls into closer proximity to the inner surface of the finishing chamber, advantageously, sufficiently close to prevent passage of substantial amounts of loose finishing material from passing between the transverse walls and the inner surface of the finishing chamber.

39 Claims, 20 Drawing Figures

COMPRESSOR
FILTER
4 WAY VALVE
SOL.
SW.
TIMING DEVICE
122
118
126
124
130
128
116
120
132
134
136
112
114
108
110
98
104
106
102
96
100
78
76
72
82
80
70
66
68
64
18
58
60
74
56
94
18a
18b
62
16
56a
12
90
92

SURFACE FINISHING MACHINE

BACKGROUND OF THE INVENTION

1. Field of Invention

This invention relates to the surface finishing of parts or workpieces with loose finishing material in a vibratory finishing chamber while maintaining each part or group of parts isolated from each other to prevent or minimize damage to them as a result of collision between parts, and is particularly directed to an apparatus in which the parts are confined by individual part-isolating means comprising transverse walls forming individual compartments; which transverse walls are maintained in close proximity with the inner surface of the finishing chamber and which travel along with the parts and the loose finishing material, in which means are provided for effecting closer proximity between the edges of said transverse wall and the interior walls of said finishing chamber for better isolation of an individual compartment interior of said finishing chamber and which, if desired, can be brought into a sufficiently close proximity to prevent passage of substantial amounts of loose finishing material into one individual compartment from adjacent individual compartments, and which can be stopped, if desired, in a discharge zone with the part-isolating means straddling a discharge means thereof. The loose finishing material and/or the part or group of parts in any one individual chamber can be the same or different from that in any other individual chamber.

PRIOR ART

Finishing apparatus, including vibratory finishing machines, have become well established in the art. The Balz U.S. Pat. No. 3,161,993,U.S. Pat. No. Re. 27,084, is an excellent example of the forward status of the art. However, all problems in the finishing area have not as yet been solved. For example, the problem of part impingement upon parts during the finishing process, with resultant surface damage, e.g., nicking of the parts, especially when large parts are involved, continues to present a problem which demands resolution. One effort along these lines is represented by Hendey et al., British specification No. 959,824, published June 3, 1964, but this effort leaves much to be desired, since it contemplates driving of the parts, by means not mounted for vibration with the machine, in apparatus which requires hand mounting or fixturing or agglomeration of parts in corners, and suggests no solution to the ever-present problem of separation of finished parts from finishing material, much less return of finishing material for re-use in the process. The solution by Hendey et al. leaves much to be desired and, indeed goes little beyond the old concept of fixturing, such as represented by Ferrara U.S. Pat. No. 3,464,163, also a completely passe and unsatisfactory solution to the problem, especially in view of the great amount of hand labor involved, in both cases, including the fixturing operation or other part processing or individual separation of finished parts. A further solution to the problem is presented by Balz, German OLS No. 24 53 240,dated May 15, 1975, and a version of the Balz development is further detailed in Walther, German OLS No. 23 64 265, dated July 3, 1975. The structures proposed in these applications go far toward a solution of the problem, but do not provide any means for ready sealing of individual compartments to the walls of the finishing chamber when in a discharge zone, that is, when the parts and finishing material are being discharged for purposes of separating finished parts from the finishing material. Moreover, although retardation of the forward motion of the part-isolating means has been suggested by Balz, the positive engagement of the interior walls of the finishing chamber by the exterior edges of the part-isolating means within the finishing chamber has not been suggested, nor any other means of temporarily integrating the part-isolating means and the interior walls of the finishing chamber into individual close fitting if not sealed compartments within which the individual parts may be finished in the usual vibratory manner and from which finished parts and finishing material may be conveniently discharged when in a discharge zone without infiltration of finishing material into the compartment being discharged from adjacent compartments, with resultant disadvantage of non-uniform amounts of finishing material in the various individual chambers and less than adequate ratios of finishing material to parts being finished in a particular chamber, to mention a few. The present invention avoids all of these previous disadvantages and provides a means for retarding forward motion of the part-isolating means, which is otherwise adapted to proceed along the finishing chamber at the same rate as and together with the contents of the finishing chamber, as well as for sealing the individual chambers on both sides of a discharge port provided in a discharge zone of the finishing chamber when a particular compartment is in the said discharge zone for discharging the contents thereof.

OBJECT OF THE INVENTION

It is an object of the invention to provide new and improved surface finishing apparatus. It is a further object of the invention to provide surface finishing apparatus which avoids the disadvantages of the prior art. It is a further object of the invention to provide surface finishing apparatus which effectively protects the part or group of parts being finished from contact one with another and at the same time provides for effective removal or discharge of any part or group of parts and its associated finishing material without disturbing the other parts or groups of parts and the finishing material associated therewith. It is a further object of the invention to provide means for stopping the transverse movement of parts and finishing material in the vibratory finishing machine without having to stop the finishing action and, if desired, discharging one part and associated finishing material from the apparatus without disturbing the other parts and the finishing material associated therewith. Still other objects will appear as the description proceeds.

SUMMARY OF THE INVENTION

The invention relates to the surface finishing of parts or workpieces with loose finishing material while maintaining each part or group of parts isolated from each other to prevent damage as a result of collision between parts, which has a resiliently-supported vibratory finishing chamber in which the parts or workpieces are vibrated with the finishing material in the chamber and in which the part-isolating means comprises transverse walls for separating the interior of the finishing chamber into individual compartments, which walls are adapted to to be carried along with the contents of the finishing chamber and are supported for such movement together with the contents of the finishing chamber and have edges thereof in close proximity to the walls of said finishing chamber and, characterised in that means are provided for effecting closer proximity between the edges of said transverse walls and the interior walls of said finishing chamber for better isolation of an individual compartment interior of said finishing chamber. Advantageously, the said closer proximity is sufficiently close to prevent passage of substantial amounts of loose finishing material into one individual compartment from adjacent individual compartments. Advantageously, also, the means for effecting closer proximity also includes stopping means for stopping movement of the part-isolating means along said finishing chamber and more particularly the stopping means comprises engaging means for bringing at least two of said transverse walls into close engagement with the inner walls of the finishing chamber. Advantageously, also, there is included means for timingly activating the means for effecting closer proximity between the edges of said transverse walls and the interior walls of said finishing chamber. Advantageously, also, the finishing chamber comprises a discharge zone for discharge of the contents of an individual compartment when the individual compartment is in the discharge zone and wherein the means for effecting closer proximity is adapted to effect said closer proximity of the transverse walls and the interior walls of the finishing chamber when an individual compartment defined by said walls is in said discharge zone. The close proximity of the transverse walls to the inner walls of the finishing chamber may be sufficiently close to prevent passage of the parts or group of parts from one individual chamber into another, and if desired, sufficiently close to prevent passage of macro components of said loose finishing material from one individual chamber into another. The closer proximity may be sufficiently close to prevent passage of macro components of loose finishing material if the close proximity were such as to allow passage thereof, or it may be sufficiently close to stop the longitudinal or running movement of the transverse walls along with the contents of the individual chambers, or even sufficiently close to prevent substantial passage of loose finishing material from one individual chamber to another. Advantageously, there is provided a discharge zone having discharge means for discharging the contents of an individual chamber when said chamber is in the discharge zone. Advantageously, the relationship between the individual part-isolating compartments and the discharge zone is such that the transverse walls of such individual compartment straddle the discharge means in the discharge zone. Desirably, there are provided means for stopping the linear running movement of the transverse walls when an individual compartment is in position with the transverse walls thereof straddling the discharge means. Advantageously, the walls of such positioned individual compartment or the next adjacent wall or walls are brought into closer proximity to the inner walls of said finishing chamber sufficiently close to prevent passage of substantial amounts of loose finishing material from other parts of the finishing chamber into the discharge zone. Advantageously, there is provided separation means in cooperation with the discharge zone for separation of finished parts from finishing material which separation means may be either internal of said finishing chamber or external of said finishing chamber and, if internal, may have a bottom which slopes upwardly to the separation means. In the later case, advantageously, the finishing chamber is annular and has an arcuate bottom with a helical rise sloping upwardly to the separation means.

The part or group of parts in one individual chamber can be different from the part or group of parts in other individual chambers and, if desired, the macro finishing material in one individual chamber can be different from that in other individual chambers. Also, if desired, there can be provided a screened outlet through which loose finishing material, especially the micro components thereof, can be bled off as desired.

When the means for effecting closer proximity brings edges of the transverse walls into such close proximity with the inner walls of the finishing chamber that there is close or substantial engagement therebetween, it will be understood that the engagement may be either a direct engagement or an engagement with a layer or film of loose finishing material between edges of the transverse walls and the inner walls of the finishing chamber. In any event, in the preferred embodiment of the invention, the means for effecting closer proximity constitutes engaging means for effecting such close engagement between edges of transverse walls and the inner walls of the finishing chamber.

More particularly the invention relates to an apparatus in which the finishing chamber is annular in shape, has a discharge port located in the bottom portion of the discharge zone of the finishing chamber, has an activating means for activating the engaging means when the transverse walls of one individual chamber have reached the point in their travel at which they straddle the discharge port, which activating means advantageously is arranged to be cocked each time a transverse wall passes a given point and is coupled with timing means for triggering the cocked activating means at predetermined time intervals.

Thus, the apparatus according to the invention in a preferred form comprises an annular chamber arranged to be vibrated with a vibratory motion which causes loose finishing material contained therein to move longitudinally of the annulus and to carry along with it parts or workpieces therein in which the parts or group of parts are maintained in separate individual chambers by transverse walls depending into the finishing chamber in sufficiently close engagement to prevent workpieces passing from one chamber to the other chamber, but not so close as to prevent free movement of the transverse walls along with the loose finishing material and the parts or workpieces. The transverse walls and the finishing chamber are so constructed that, when desired, a close engagement between them can be effected, thereby sealing off the individual compartments, or at least one of them, when it is in the discharge zone and the transverse walls straddle the discharge means or port. When the transverse walls of one individual chamber is so positioned relative to the discharge means and a close engagement is effected, the material to be finished (part or group of parts) therein, together with the associated loose finishing material can be discharged through the port without affecting the material to be finished and loose finishing material in other individual chambers of the finishing chamber. This can be done, too, while the vibratory motion and the finishing action in the other individual chambers of the finishing chamber is continued. Once the material to be finished and loose finishing material are discharged, they can be separated and the loose finishing material returned for further processing. Thus, the necessity for completely recharging the finishing chamber periodically or continuously feeding loose finishing material thereinto and continuously withdrawing it through a discharge means is entirely avoided. Also, when the transverse walls are not in close engagement with the finishing chamber, there is the possibility of free flow of liquid finishing material from one individual chamber into another so that, if desired, while the finishing operation is going on and the parts and associated loose finishing material and transverse walls are being carried along the finishing chamber, liquid finishing material can be added as desired and excess liquid finishing material bled off as desired. Thus, the apparatus according to the invention provides a highly versatile machine whereby parts or workpieces can be surface finished speedily and effectively with a minimum inadvertant damage to the parts.

To cushion the workpieces, the finishing chamber is lined with an elastomeric or resilient material, for example, polyurethane elastomer. Also, for the same purpose, the transverse walls may be coated with like elastomeric or resilient material. Advantage of this may be taken in order to effect the desired closer proximity between the transverse walls and the inner surface of the finishing chamber. Thus, either the lining of the interior walls of the finishing chamber or the coating of the transverse walls may be arranged to be expanded into contact with the other, thereby effecting closer proximity between the two.

One suitable arrangement for effecting this is to provide hollow tubes around the outer edge of the transverse walls and to expand the tubes, for example, by introducing fluid under pressure. Another suitable means is to provide similar expandable tubes in the lining of the interior walls of the finishing chamber. These expandable tubes may be located in the discharge zone on each side of the discharge means and spaced apart the distance between the transverse walls of one chamber. Thus, when these tubes are expanded, the normal movement of the transverse walls will bring them into contact therewith and seal off the individual chamber that is in the discharge zone and, of course, at the same time will stop the movement of all the transverse walls, as well as the parts and the part finishing material therein. Alternatively, the expandable tubes may be expanded into positive engagement with the edges of the transverse walls after the walls have moved to a position apposed to the expandable tubes.

Still another modification is to provide a segmented or articulate transverse wall coated with an elastomeric or resilient material and to provide means for expanding the segments, thus stretching the elastomeric coating into closer proximity to the inner surface of the finishing chamber.

In another form of the invention, the closer proximity can be effected by providing transverse walls having a complementary shape to the cross-section of the finishing chamber and moving the transverse walls in such a manner that in one position the edges thereof are in close proximity to the inner surface of the finishing chamber and, in another position, they are in closer proximity thereto.

One means for accomplishing this is to provide a finishing chamber having outwardly flaring walls and to provide means for lowering a transverse wall having a complementary shape into contact with the inner surface of the finishing chamber and for raising it out of contact therewith.

In accordance with another modification, the transverse wall is mounted for rotation about a vertical axis coordinated with a simultaneous rotation about a horizontal axis.

Still another means for accomplishing this is to have the transverse wall mounted for rotary motion about a vertical axis, together with simultaneously coordinated vertical movement.

Still another modification is to shape the transverse section of the finishing chamber and the transverse walls as complementary spirals, mounted about the transverse walls for pivotal movement about the origin of the spiral, and rotate it about the pivot to lower it into contact with the inner surface of the finishing chamber or to raise it to a position where the edges thereof are uniformly spaced from the inner surface of the finishing chamber.

In the operation according to a preferred form of the invention, the vibratory motion of the finishing chamber causes the loose finishing material to swirl about the parts to be finished therein and to move longitudinally of the chamber and at the time carry the freely mounted transverse walls along therewith. At predetermined intervals, or when desired, the transverse walls may be brought into engagement with the inner surface of the finishing chamber either throughout the length of the finishing chamber or just at the discharge zone, as desired. The longitudinal movement of the transverse walls and the content of the individual chamber is thereby stopped. It may be desirable to do this simply for the purpose of controlling the finishing action in the finishing chamber or, for the purpose of discharging the contents of the individual chamber which is positioned in the discharge zone.

Suitable activating means operates to activate the means for causing closer proximity between the transverse walls and the inner surface of the finishing chamber only at predetermined positions, for example, when one pair of the transverse walls straddle the discharge means in the discharge zone. Cocking means is provided to cock the activating means at said predetermined positions. Timing means determines at what time the cocked activating means is triggered. Thus, an individual chamber may pass the predetermined position any number of times desired before the cocked activating means is triggered to cause the closer proximity means to bring the transverse walls into closer proximity to the inner surface of the finishing chamber. Also, the timing means may be programmed to determine the length of time that the transverse walls are maintained in closer proximity to the inner surface of the finishing chamber.

When a workpiece and loose finishing material are discharged from the individual chamber positioned in the discharge zone, the two can be separated by a screen or other suitable means and the separated loose finishing material returned to the apparatus. Advantageously, it is returned to the same individual chamber that it was discharged from. This, advantageously, is effected while the individual chamber is still sealed off in the discharge zone after the discharge port has been closed. It can, however, be effected into any of the chambers, since as soon as the engagement means are released, communication among all the chambers is established again and excess material in any one chamber will pass into an adjacent chamber, but of course only if the relative size of finishing material and the clearance between the transverse walls and the finishing chamber walls is such as to permit this.

DETAILED DESCRIPTION OF THE INVENTION

Figure 1:
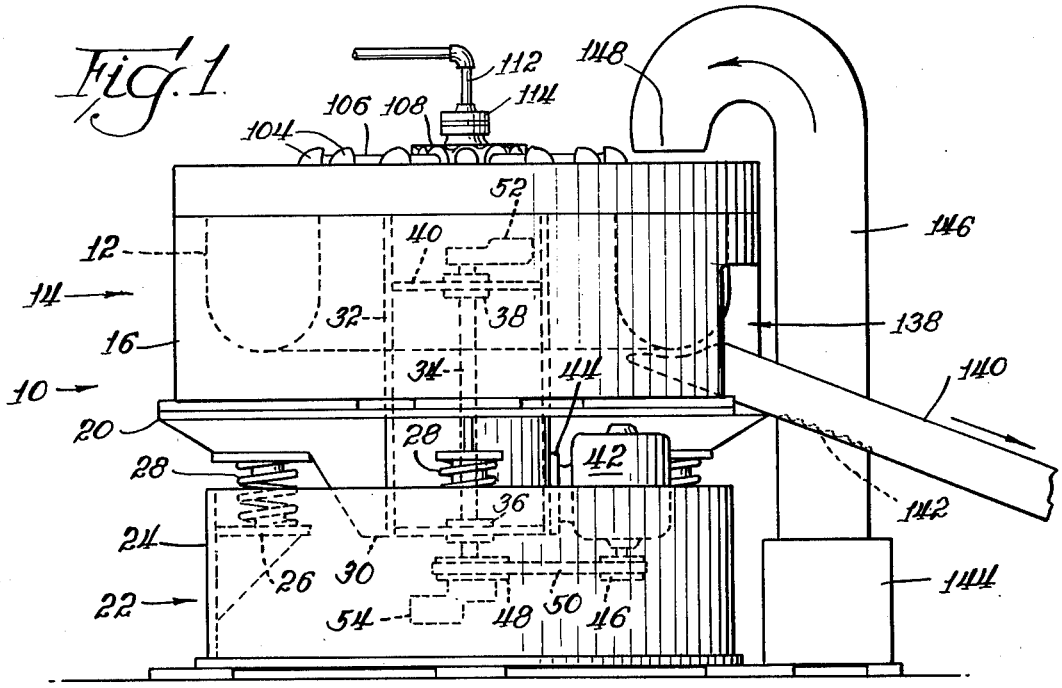
FIG. 1 is a side elevation of one form of the invention.
Figure 2:
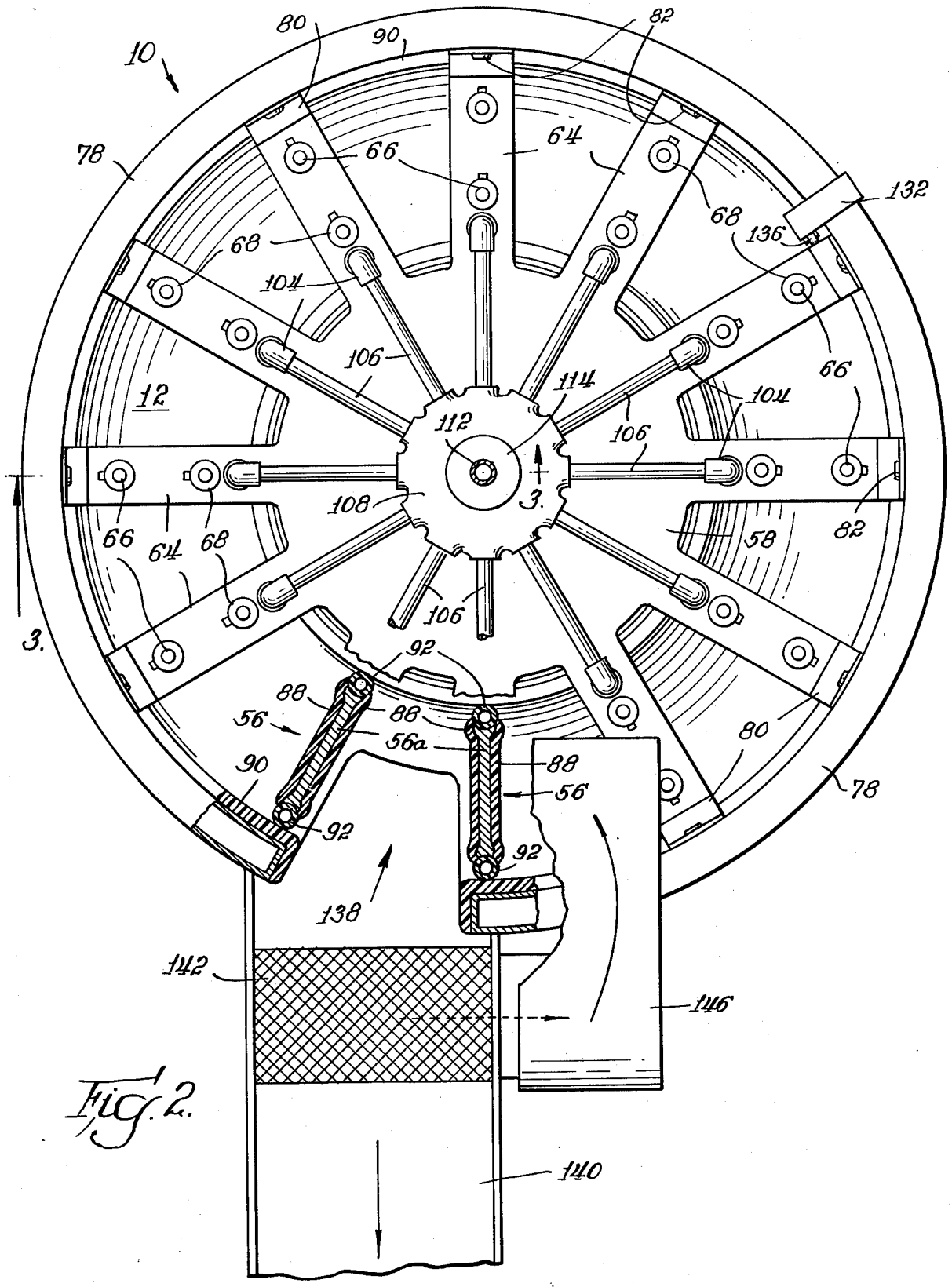
FIG. 2 is a top view of the same modification with parts broken away and shown in section.
Figure 3:
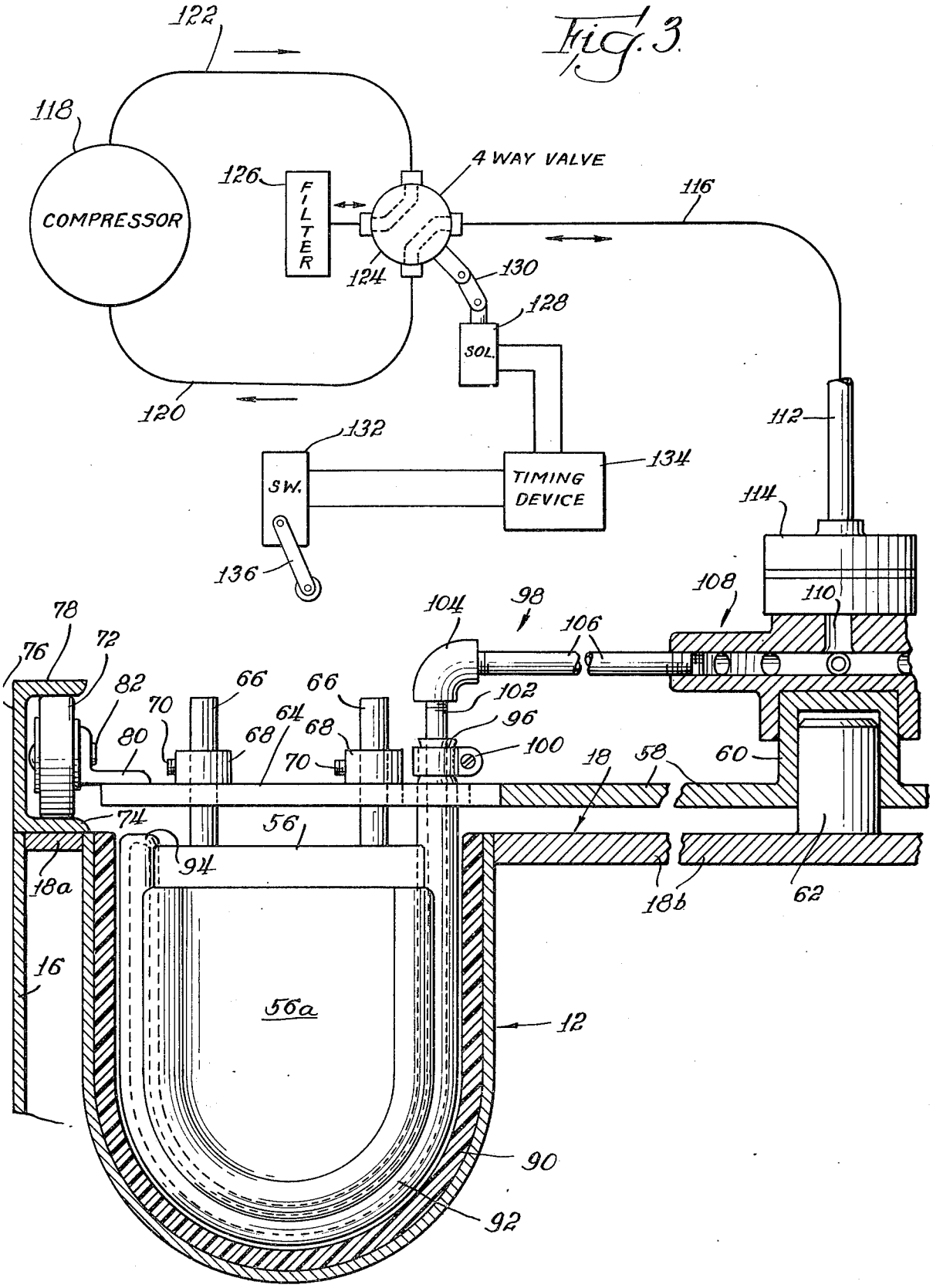
FIG. 3 is a partial section taken along line 3—3 of FIG. 2 showing diagramatically the indexing and timing mechanism.

Referring now particularly to FIGS. 1, 2, and 3, there is shown a modification of the invention in which the vibratory finishing machine 10 has an annular finishing chamber 12 of generally U-shaped cross section mounted in frame 14 having annular side walls 16 and an essentially flat top having an annular portion 18*a* between the annular side walls 16 and the annular finishing chamber 12 and a circular portion 18*b* complementary to the inner circumference of the annular finishing chamber 12.

The annular walls 16 are supported by a bottom member 20 in which in turn is supported on a hollow circular base member 22. The annular walls 24 of the base member 22 have horizontal supports 26 on which are mounted resilient means or springs 28 which support the bottom member 20. The springs 28 are spaced about the periphery of the base 22 and the bottom 20. Projecting upwardly from the bottom 30 of the bottom member 20 to the circular portion 18*b* of the top wall is a cylindrical support means 32 which not only provides support for the cylinder portion 18*b* but also provides support for the vibrating mechanism.

The vibrating mechanism comprises a vertical shaft 34 journaled at 36 in the bottom 30 of the bottom member 20 and at 38 in a transverse cross head 40 in the cylindrical support 32.

The cylindrical shaft 34 is driven by motor 42 mounted at 44 on the cylindrical support 32 at 44 through pulleys 46 and 48 and belt 50. Fastened to the top of shaft 38 is off-center weight 52 and fastened to the bottom of shaft 34 is an off-center weight 54. The off-center portions of the off-center weights 52 and 54 are diametrically opposite to each other so that when rotation is imparted to shaft 34 the vibratory motion is imparted to the upper portion of the device which includes the finishing chamber 12, the annular side walls 16, the bottom member 20, and motor 42. In other words, the whole upper portion of the device resting on the resilient springs 28, including the vibratory mechanism, is vibrated.

The vibratory motion thus induced causes loose finishing material in the finishing chamber 12, including the workpieces or parts to be finished, to move in a transverse circular motion and to also move longitudinally in the finishing chamber. The workpieces or parts to be finished are thus acted upon the loose finishing material until the desired degree of finishing is obtained, after which they are removed from the finishing chamber in a manner to be more particularly described.

In order to keep the workpieces or parts to be finished separated one from the other and thus to avoid nicking and otherwise damaging them through contact one with the other, there are provided a series of spaced transverse walls. These walls depend from and are supported by a sprocket 58 having a central bearing 60 journaled on the upstanding axial trunnion 62. The arms 64 of the sprocket 58 span the annular finishing chamber 12 and are uniformly spaced about the periphery thereof so that the transverse walls 56 which are supported therefrom form individual compartments of uniform size about the periphery of the finishing chamber 12.

The transverse walls 56 suitably are supported by the rods 66 which pass through the collars 68 affixed to the arm 64. Set screws 70 allow adjustment of the rods 66 up and down to provide the desired spacing of the transverse wall 56 from the inner surface of the finishing chamber 12. The outer ends of the arms 64 are supported by rollers 72 adapted to roll on the annular track 74 on top of the annular portion 18*a* of the top surface 18 of the apparatus. A projection 76 of the annular wall 16 extends upwardly from the track 74 and carries at its top an annular guard member 78 spaced slightly from the top of the roller 72 to prevent any inadvertent upward movement of the arm 64, and to keep the transverse wall 56 in a close predetermined relationship to the finishing chamber. A suitable bracket 80 may be provided for supporting the axis 82 of the roller 72.

Each transverse wall 56 has a center portion 56*a* made of metal or other rigid material and has a surface coating 88 of elastomeric or resilient material, advantageously, polyurethane elastomer. The finishing chamber 12 has a lining 90 of like elastomeric or resilient material.

The edges of the transverse walls 56 comprise an inflatable tube 92 which in the uniflated condition is spaced from the inner surface of the finishing chamber 12 as shown in FIG. 3, but in the inflated condition is in contact therewith as shown in FIG. 2. The inflatable tube 92 has a closed end 94 and an open end 96. The open end is fastened on pipe 98 by hose clamp 100. The pipe 98 comprises a nipple 102, an elbow 104, and a horizontal portion 106 which communicates with the manifold 108. The manifold 108 communicates through the axial port 110 with the pipe 112 by means of a rotary connection 114. Air pressure is supplied to pipe 112 by line 116 from compressor 118. Compressor 118 has inlet and outlet lines 120 and 122, respectively, which communicate with the 4-way valve 124. In the position shown for the 4-way valve 124, the output of the compressor passes through the 4-way valve and out into the filter 126 and the inlet line 120 communicates with the pipe 112 through line 116, thereby exhausting the collapsible tube 92. When the 4-way valve is rotated 90° either way, the output of the compressor is then connected through line 116 to the pipe 112 and the input to the compressor is connected to the filter through the 4-way valve and line 120. Thus, air is drawn into the filter, passes through the compressor, and out to the line 120 to expand the tube 92.

The 4-way valve can be operated by any suitable mechanism, such as the solenoid 128 and mechanism 130 (shown diagramatically). The solenoid 128 is actuated by a combination of the switch mechanism 132 and the timing device 134. The switch mechanism 132 may be located on the guard member 78 at a position such that the switch is closed each time an arm 64 contacts the switch actuating arm 136. Switch 132 is positioned so that it is closed whenever a pair of transverse walls are in the discharge zone as shown in FIG. 2, and this functions to cock the means for actuating the engaging means.

The timing mechanism 134 is programmed to determine which individual chamber, and when that individual chamber will be stopped in the discharge zone. Thus, for the solenoid to be actuated or triggered, both the switch and the timing device must be in position to close the circuit. The switch arm 136 may ride over any given number of sprocket arms 64 without functioning as the cocking mechanism until such time as the timing device shall trigger it by closing the circuit. After the timing device closes the circuit the next time the arm 136 rides over a sprocket arm 64, the cocked activating mechanism will be triggered and the tube 92 expanded in the position shown in FIG. 2.

The timing device is also programmed to determine how long the individual chamber will be retained in the discharge zone shown in FIG. 2. While it is in that position, the switch 136 is closed and the timing device switch is closed. After the desired interval, the timing device switch is opened allowing the solenoid to return to the position shown in FIG. 3, wherein the tube 92 is deflated so that movement of the transverse walls 56 can resume.

The discharge zone has a discharge port 138 through which the contents of the individual chamber can be discharged. The discharge port can be closed by a suitable door not shown in this figure but which will be described more particularly in regard to the modification shown in FIG. 6. Fail-safe means (not shown), may be provided, if desired, to prevent deflating of the tubes 92 when the discharge port is open.

The discharge port 138 communicates with vibratory chute 140 having a screen 142 in the bottom thereof through which the loose finishing material can pass and thus be separated from the finished part which continues on down the chute 140. The loose finishing material passing through the screen 142 falls into the hopper 144 from which it is returned to the system by the elevator 146. The discharge end 148 of the elevator 146 is advantageously arranged to discharge the loose finishing material into the individual chamber while it is still in the discharge zone but after the door has been closed. A new part to be finished can be added at that time, or later, as desired.

Figure 4:
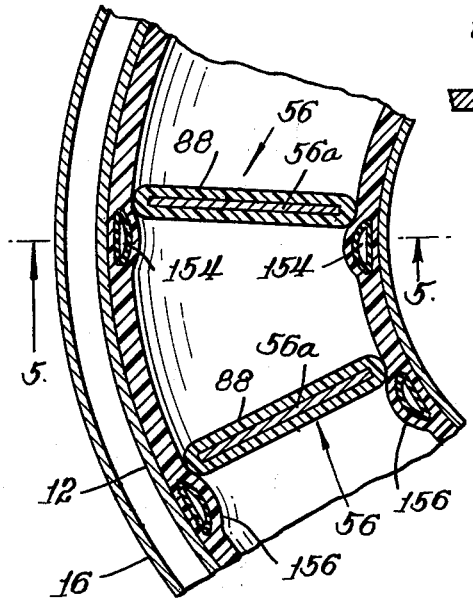
FIG. 4 is a partial view in horizontal section of a modified form of the invention.
Figure 5:
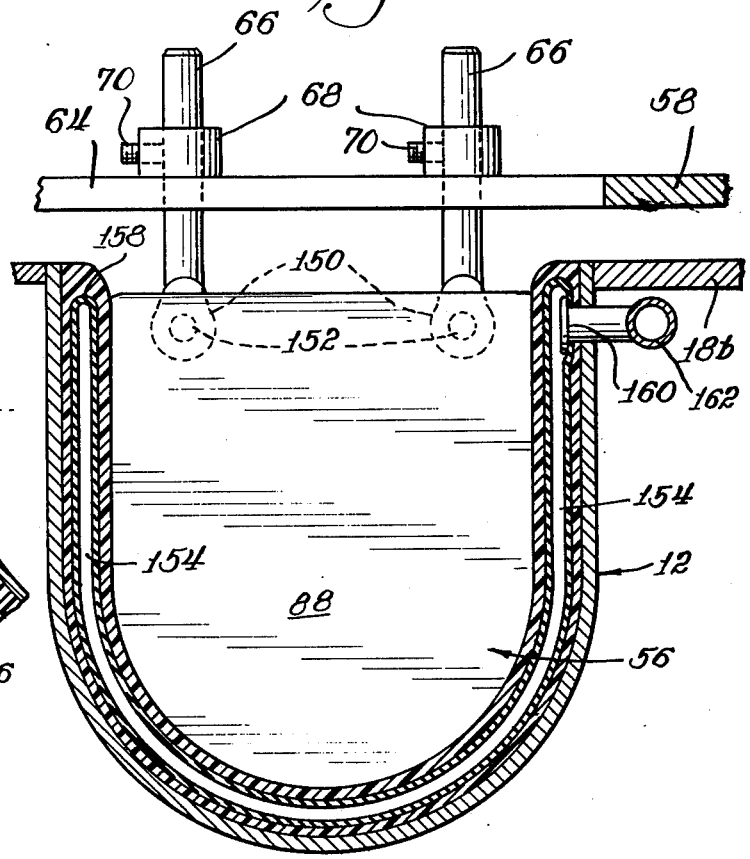
FIG. 5 is a transverse section of FIG. 4 taken along line 5—5.

In the modification shown in FIG. 4 and 5, the transverse walls 56 are suspended in the same way as in FIGS. 1,2, and 3, the rod 66 being flattened at 150 and rigidly secured to the rigid portion **56*a* by rivets 152 or like fasteners. The transverse walls 56 are then coated completely with the coating 88** of elastomeric or resilient material.

Instead of having inflatable tubes on the outer edge of the transverse walls 56, there are provided inflatable tubes 154 and 156 in the lining 90 of the finishing chamber 12. These tubes extend down one side, across the bottom and up the other side of the finishing chamber as shown in FIG. 5. The tubes may have one closed end 158 and the other end open at 160 with the opening communicating through pipe 162 with pipe 112.

The tubes 154 and 156 are spaced apart the same distance that the adjacent transverse walls 56 are spaced apart so that when the tubes 154 and 156 are inflated as shown in FIG. 4. longitudinal movement of the transverse walls 56 is blocked by the inflated tubes.

The indexing mechanism is so adjusted that the tubes inflate after one of the pair of transverse walls passes the tube 154 and before it reaches tube 156 but, if desired, could be set so that the tubes inflate when the transverse walls are exactly opposite the tubes so that the expanded tubes firmly grip the edges of the transverse walls. Otherwise, the indexing mechanism operates exactly as in the modification of FIGS. 1, 2, 3, and 4.

Figure 6:
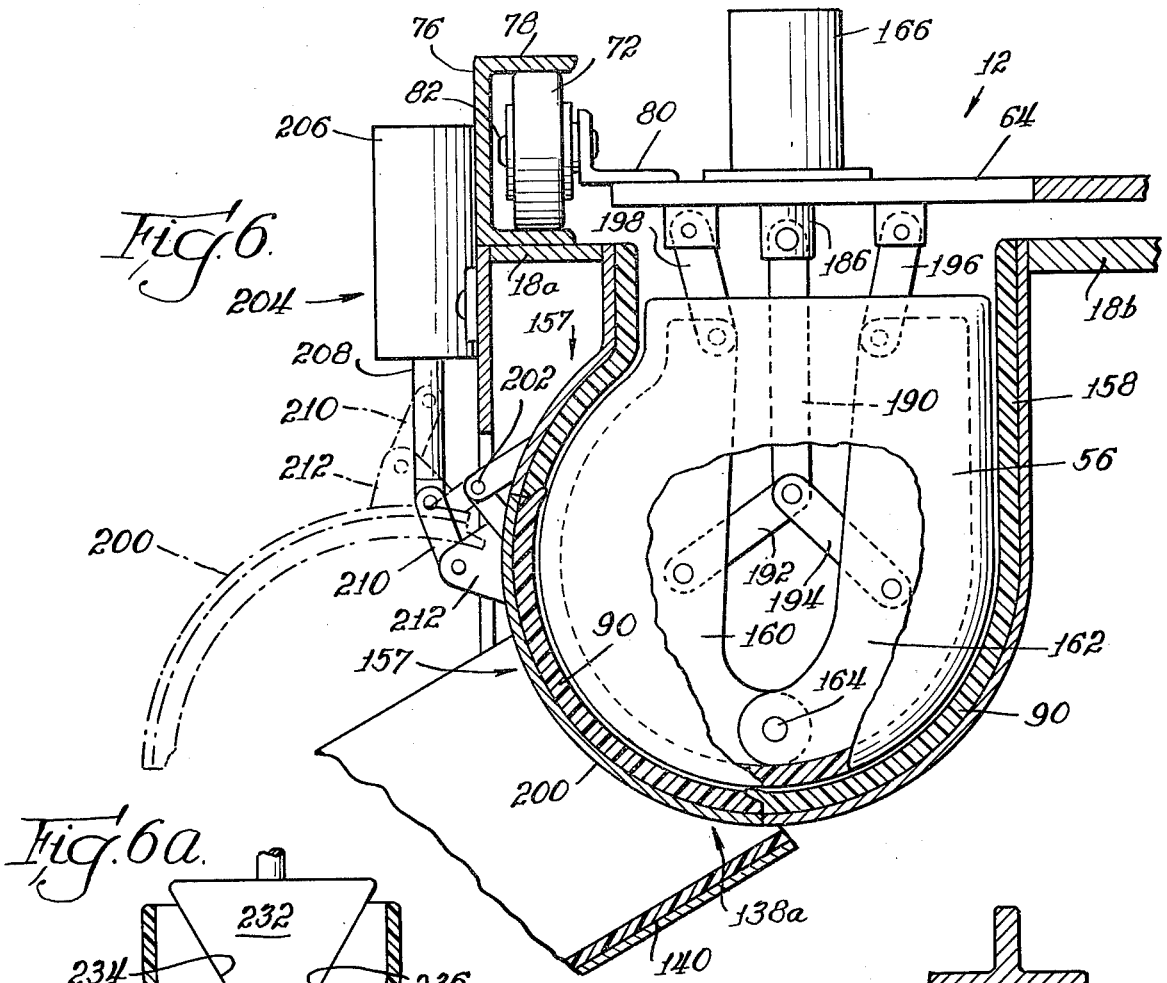
FIG. 6 is a partial view in transverse section of a further modification.

In the modification shown in FIG. 6, the finishing chamber 12 has an enlarged bulbous portion 157 on the outside of the annulus which is arcuate or semi-circular, in the case shown, covering an arc of about 240°, in transverse section. Inner wall 158 extends downward vertically to essentially the elevation of the center of the semi-circular portion and then along the semi-circle up to a point adjacent the annular top portion **18*a*** whence it extends vertically up to it.

The transverse walls 56 have a complementary shape.

The inner hard or rigid portion is segmented in two segments 160 and 162 which are hinged at the bottom at 164. Mounted on the arm 64 is a pressure fluid cylinder 166 adapted to reciprocate the piston rod 186 on the vertical axis. Linked to the piston rod 186 is a toggle mechanism comprising links 190, 192, and 194. Link 190 is pivoted to the piston rod 186 and to links 192 and 194 and links 192 and 194 are pivoted, respectively, to segments 160 and 162 in a manner such that downward movement of piston rod 186 causes the links 192 and 194 to push the segments 160 and 162 outwardly and thus stretch the elastomeric or resilient coating into contact with the inner lining of the finishing chamber. Supporting links 196 and 198 connect the transverse walls 56 with the arm 64 and hold the transverse walls 56 in a position such that in its unexpanded condition, there is a uniform space between the edge of the transverse wall 56 and the inner lining of the finishing chamber 12. The links 196 and 198 are resiliently extendable and return to the position shown in FIG. 6. Advantageously, they may be made of strong elastomeric material. Thus, when the piston rod 186 moves downwardly and the segments are expanded outwardly at the same time the bottom portion is moved downwardly so that all of the edge of the transverse wall 56 is in contact with the lining of the finishing chamber.

In the bottom portion of the bulbous portion of the finishing chamber there is provided a discharge opening or port 138*a* adapted to be closed by the cover 200. When the cover 200 is closed, the elastomeric lining 90 provides a complete seal of the port and prevents loss of liquid or other material therethrough. The closure 200 is hinged at 202 and is actuated by opening and closing mechanism 204 comprising a fluid pressure cylinder 206, a piston rod 208, and a link 210 connecting the piston rod 208 to a bracket 212 fastened to the cover 200.

The circuit operating the pressure cylinder 166 is integrated with the switch 132 and the timing device 134 so that closing of the switch 132 and the timing device 134 feeds fluid pressure to the cylinder 166 thereby causing expansion of the transverse wall 56 into contact with the inner lining of the finishing chamber, and opening of the switch in the timing device causes the pressure fluid to be reversed to the cylinder 166 so that the piston rod 186 is retracted and the transverse wall 56 allowed to assume its normal position. Also, if desired, the pressure cylinder 206 can be integrated with the indexing mechanism so that the door can be opened only when the transverse walls are in the position shown in FIG. 2 and extended into close engagement with the inner surface of the finishing chamber and so that the transverse walls cannot be actuated to normal position as long as the door 200 is not closed.

Figure 6A:
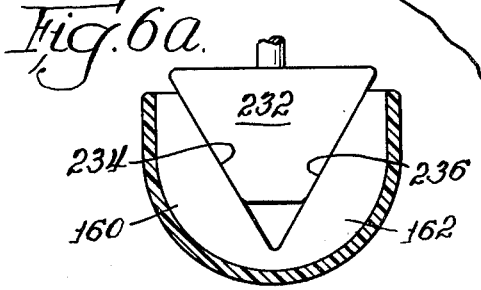
FIG. 6*a* is a transverse section of a modification of FIG. 6.

FIG. 6*a* is a modification of FIG. 6, in which the link mechanism 192–194 is replaced by a wedge 232 which acts on the cam surfaces 234 and 236 on the segments 160 and 162, respectively, so that when piston rod 186 moves downwardly, the segments 160 and 162 move outwardly and downwardly, thus forcing the elastomeric coating into contact with the lining of the inner surface of the finishing chamber.

Figure 7:
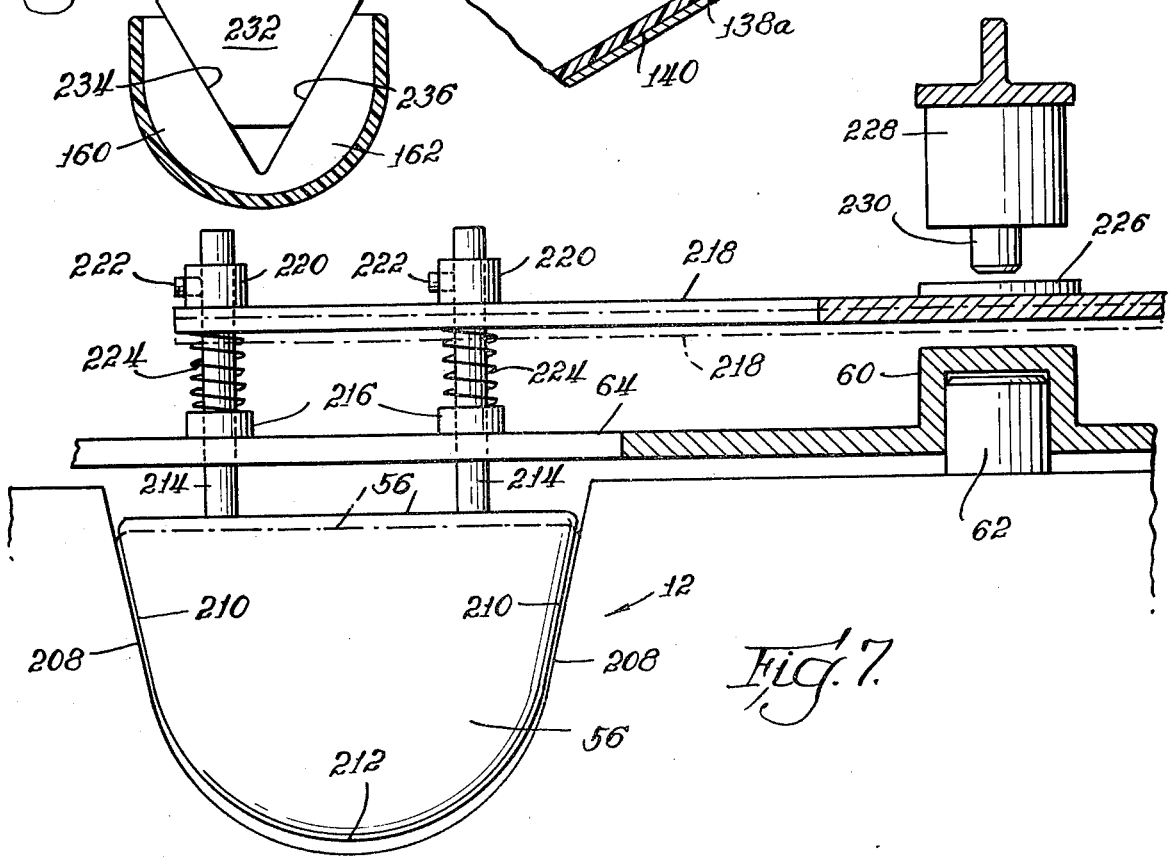
FIG. 7 is a schematic view of a transverse section of another modification.
Figure 8:
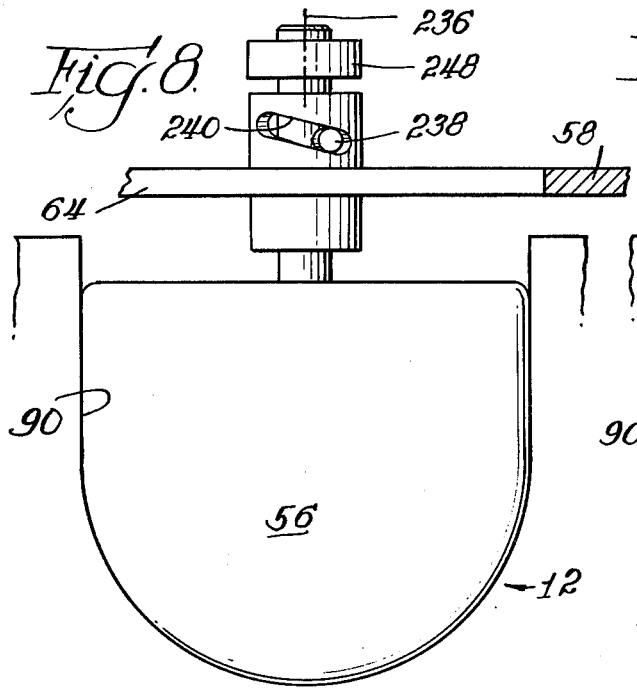
FIG. 8 is a schematic view in transverse section of another modification in which the transverse wall is shown in close engagement with the inner surface of the finishing chamber.

In the modification shown in FIG. 7, the sidewalls 208 of the finishing chamber flare outwardly and the transverse walls 56 have a complementary shape so that in raised position, the side edges 210 and the bottom arcuate edge 212 are spaced from the corresponding portions of the finishing chamber 12, and in the lowered position as shown in the dotted lines, the edges of the transverse walls contact the corresponding portions of the inner surface of the finishing chamber 12 throughout.

The transverse walls 56 are provided with upstanding rods 214 rigidly attached to said walls, projecting up through guides 216 attached to the arms 64.

The rods 214 are fastened to a transverse or radial member 218 by the collars 220 and set screws 222, and springs 224 are provided urging the transverse member 18 upwardly, and thus raising the transverse wall 56 to its raised position. Suitable stops, not shown, are provided to limit the upward movement of the rods 214. The transverse members 218 are arms of a sprocket corresponding to the arms 64 of the sprocket 58. Thus, the transverse walls 56 can be depressed to the closed position by pushing down on the center portion 226 of this sprocket. A fluid pressure cylinder 228 actuating the piston rod 230 effects this and is integrated with the indexing mechanism the same way as fluid pressure cylinder 166.

Figure 9:
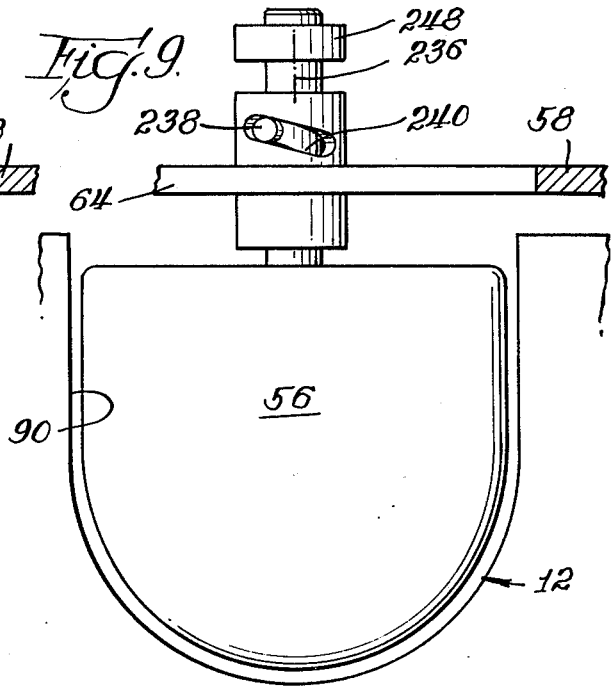
FIG. 9 is a like view of the same modification as FIG. 8, showing the transverse wall spaced from the inner surface of the finishing chamber.

In the modification shown in FIGS. 8, 9, 10, and 11, the transverse wall 56 is mounted for rotation on vertical axis 236 having a cam rider 238 riding on cam surface 240 arranged so that rotation about the axis 236 simultaneously imparts a vertical motion to the transverse wall 56. Thus, when the transverse wall is in the position shown in FIG. 10, it functions much like a butterfly valve to bring the transverse wall 56 into close engagement with the inner surface of the finishing chamber. When it is in the position shown in FIG. 11, it brings the lateral edges of the transverse wall 56 out of contact with the lateral edges of the inner surface of the finishing chamber 12 and the bottom edge of the transverse wall 56 out of contact with the bottom surface of the inner surface of the finishing chamber as shown in FIG. 9.

Figure 10:
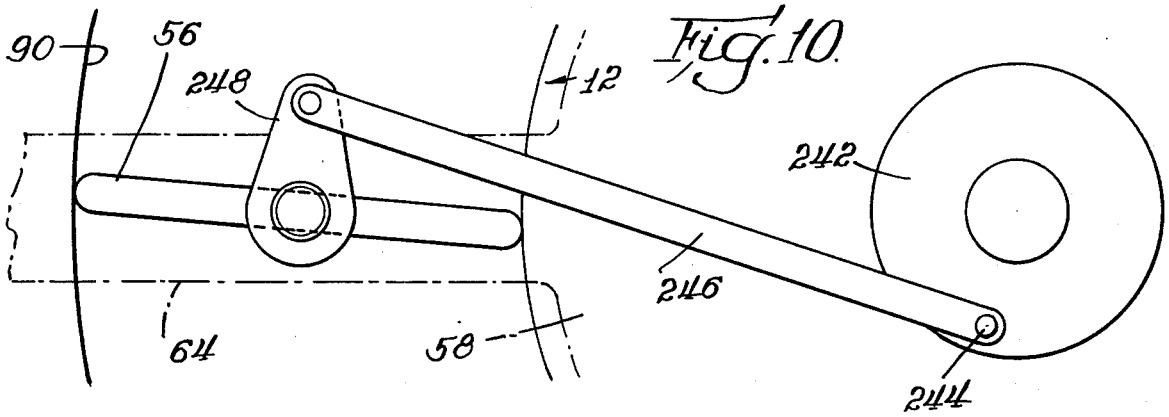
FIG. 10 is a schematic top view of FIG. 8.
Figure 11:
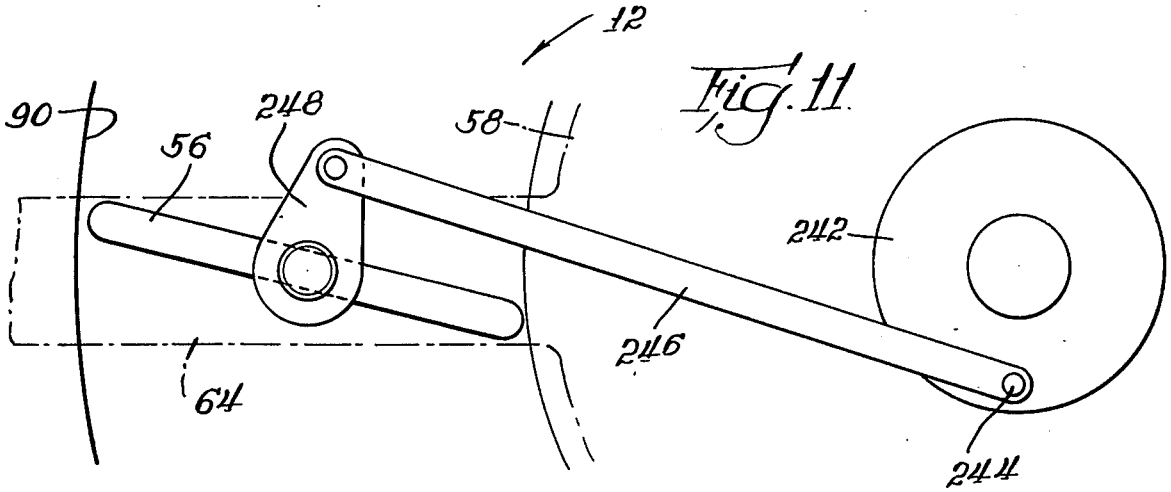
FIG. 11 is a schematic top view of FIG. 9.

As shown in FIGS. 10 and 11, at the center of the sprocket 58 there may be provided a rotatable disc 242 having a plurality of cranks 244 mounted thereon, each of which is attached by a rod 246 to a crank 248 affixed to the vertical axis or shaft 236. Thus, rotation of the disc 242 of FIG. 10 in a clockwise direction, causes the transverse walls 56 to assume the position shown in FIGS. 8 and 10.

In the modification just described, the vertical movement is coordinated with the rotation about the vertical axis, that is, the extent of the vertical movement is so correlated with the extent of the rotation about the vertical axis that in the position shown in FIG. 11, the edges of the transverse walls 56 are substantially uniformly spaced from the sides and the bottom of the inner surface of the finishing chamber 12.

Instead of using the crank 248 to impart rotation to the axis 236, the axis may be reciprocated and rotation imparted thereto by the action of cam surface 240. Thus, the axis may be connected to or be an extension of a piston rod or a fluid pressure activated cylinder such as that shown at 166, and when this piston rod is being extended, the cam surface 240, if properly shaped, will effect a rotation from the position shown in FIG. 10 to that shown in FIG. 11. The axis can be spring-biased to the position shown in FIG. 11, so that on retraction of the piston rod, the axis will rotate to the position shown in FIG. 11, or a second cam can be provided to impart rotation to that position.

Figure 12:
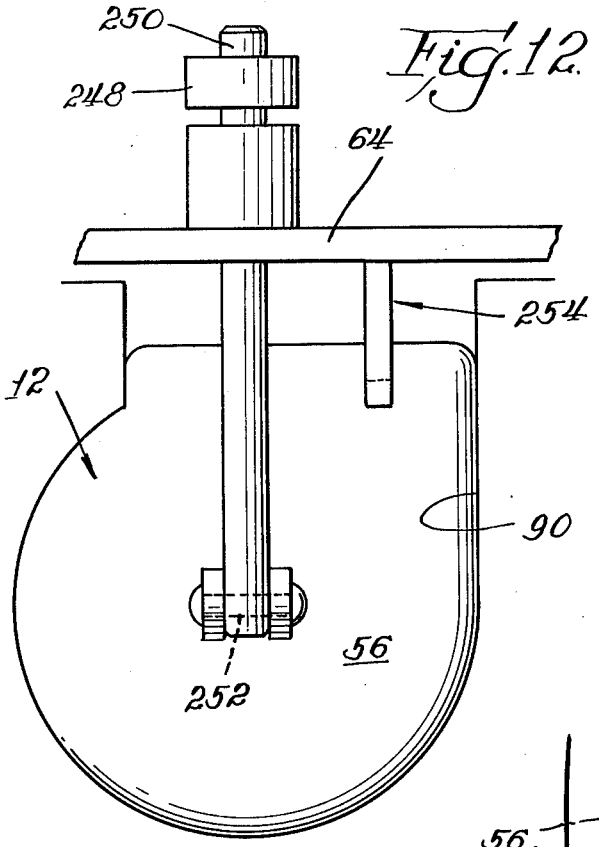
FIG. 12 is a schematic view in transverse section showing still another modification in which a transverse wall is in close engagement with the inner wall of the finishing chamber.
Figure 13:
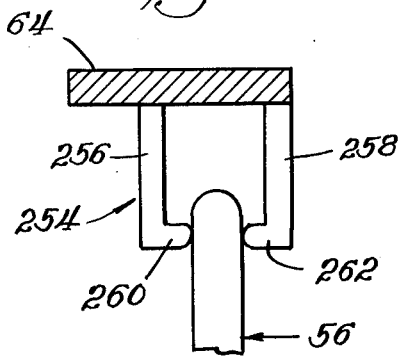
FIG. 13 is a detail view of part of FIG. 12.
Figure 15:
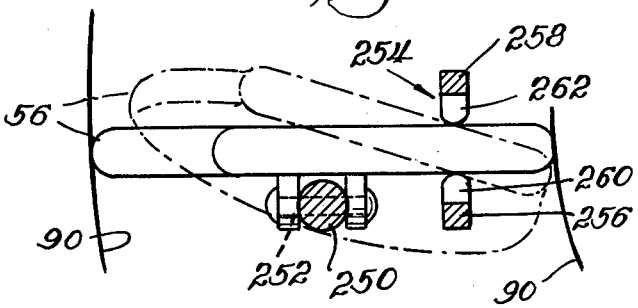
FIG. 15 is a schematic view looking down on FIGS. 12 and 14 showing the position assumed by the top of the transverse wall.
Figure 16:
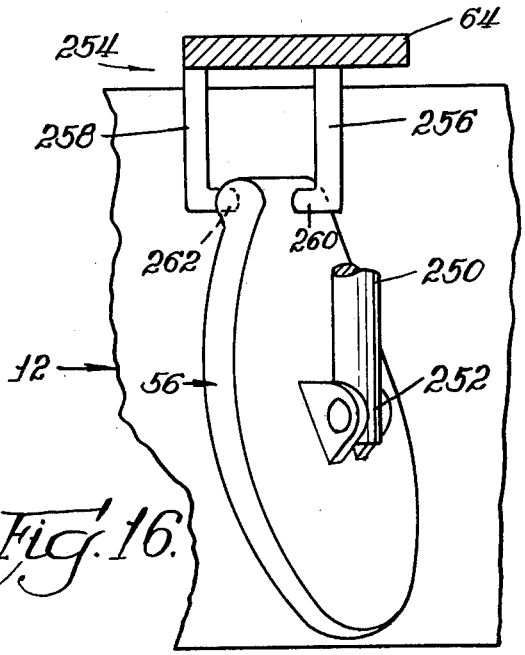
FIG. 16 is a transverse section of the transverse wall of FIG. 14, taken along line 16—16 of FIG. 14.

In the modification shown in FIGS. 12, 13, 14, 15, and 16, each transverse wall 56 is mounted for rotation about a vertical axis 250 with simultaneous coordinated rotation about a transverse or horizontal axis 252. Rotation about the vertical axis 250 can be effected the same way as in FIGS. 10 and 11 and rotation about the horizontal axis 252 can be effected by providing a yoke 254 depending from the arm 64 with the arms 256 and 258 straddling the transverse wall 56 or a vertical extension thereof and having inwardly directed apposed portions 260 and 262 adapted to move the transverse wall 56*a* forward and backward as the transverse wall 56 is rotated about the axis 250. The yoke 254 is displaced laterally from the axis 250 for this purpose. FIG. 13 shows the details of the yoke construction and FIG. 15 and 16 show the way the transverse wall 56 moves in being rotated from the position of FIG. 12 to that of FIG. 14. Thus, the transverse wall 56 in the position shown in FIG. 12 is in close engagement with the inner surface of the finishing chamber and functions much like a butterfly valve. When the vertical axis is rotated to the position shown in FIG. 14, the rotation of the transverse wall 56 about the vertical axis, coupled with simultaneous coordinated rotation about a horizontal axis causes all the edges of the transverse wall 56 to move away from the inner surface of the finishing chamber.

Figure 14:
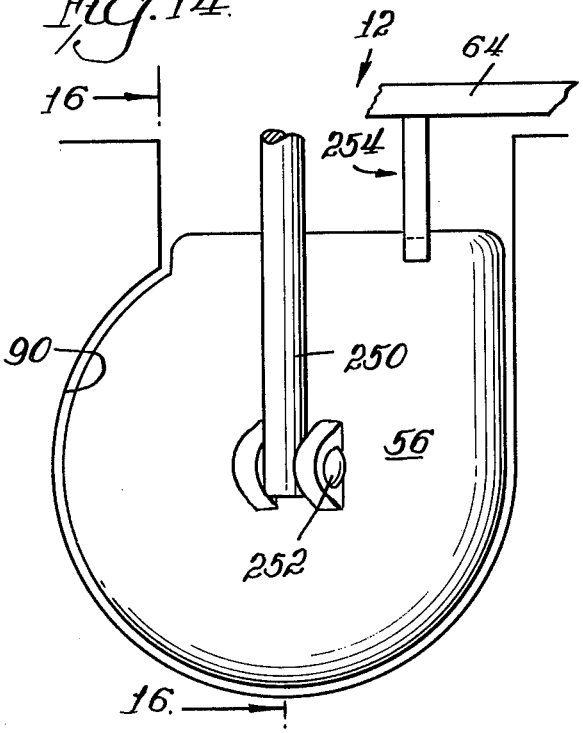
FIG. 14 is a view similar to that of FIG. 12, showing the transverse wall spaced from the inner surface of the finishing chamber.

In the modification just described, the rotation about the horizontal axis is coordinated with the rotation about the vertical axis, that is to say, the extent of the rotation about the horizontal axis is so correlated with the extent of the rotation about the vertical axis, that in the position shown in FIGS. 14 and 16, the edges of the transverse walls 56 are substantially uniformly spaced from the sides and the bottom of the inner surface of the finishing chamber 12.

Figure 17:
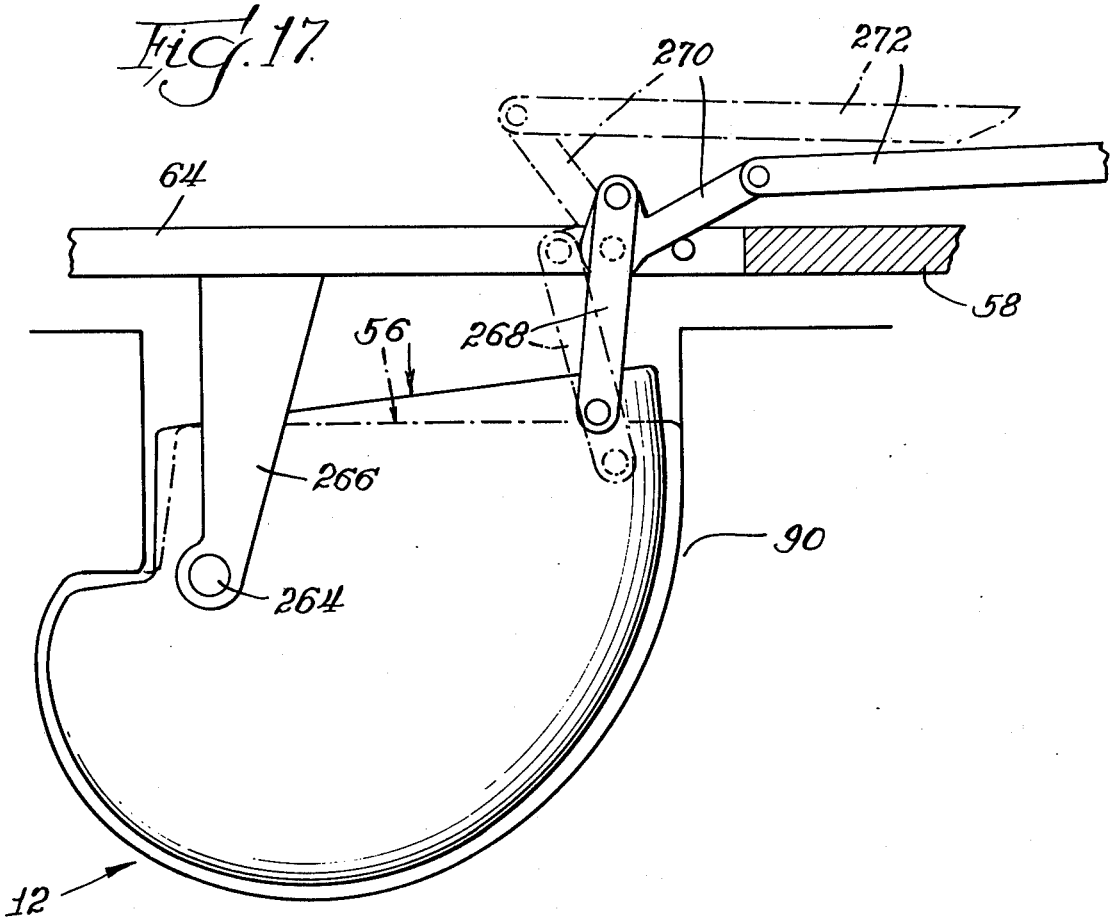
FIG. 17 is a partial view in transverse section showing a modified form of the invention.
Figure 18:
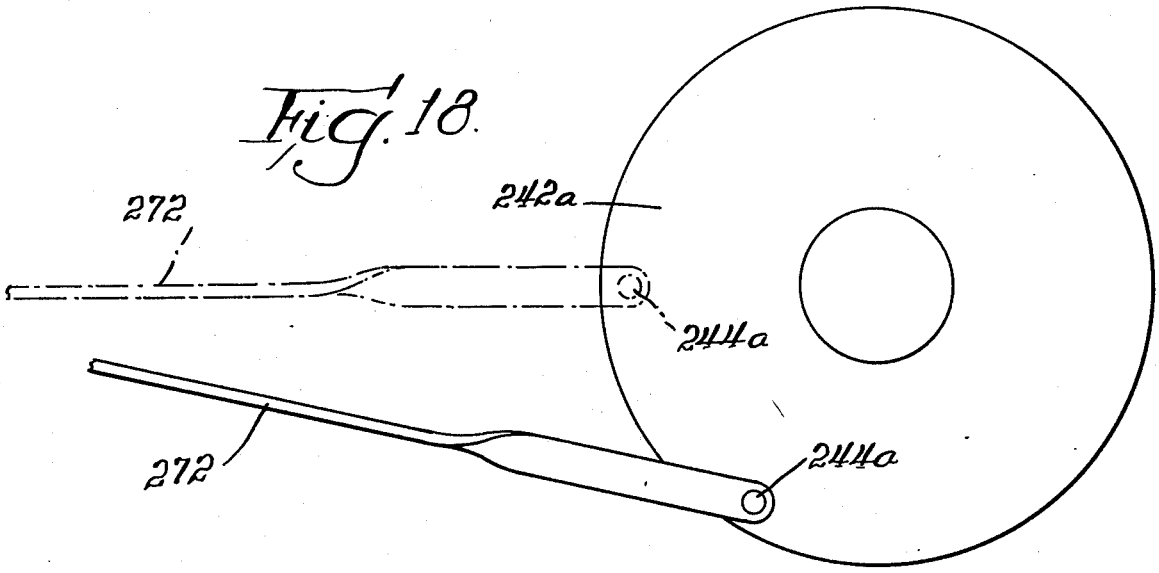
FIG. 18 is a partial view of the modification of FIG. 17.

In the modification shown in FIGS. 17 and 18, the finishing chamber has a transverse section shaped as a spiral and the transverse walls 56 have a complementary shape. Each transverse wall is pivoted by pivot 264 at the origin of the spiral, which pivot is journaled in brackets 266 depending from the arm 64. The opposite top edge of the transverse wall 56 is linked by lifting link 268 to a bell-crank 270, one of arm of which is pivoted to the link 268, and the other arm of which is connected to rod 272 which is connected to one of the cranks 244*a* on the center crank wheel or disc 242*a* at the center of the sprocket 58. Advantageously, in the raised position shown in FIG. 17, the bell-crank 270 is in dead-center position, so that the transverse wall 56 is held firmly in its elevated position. Advantageously, also, in the closed or engaged position shown in dotted lines in FIG. 17, the center crank 242*a* is in dead-center position, so that the transverse wall 56 is maintained firmly in engagement with the inner lining of the finishing chamber.

In the modification as shown in FIG. 8 through 18, one of the cranks of the center crank wheel can be connected to the piston rod of a fluid pressure cylinder which is integrated into the indexing system the same as fluid pressure cylinder 166.

Figure 19:
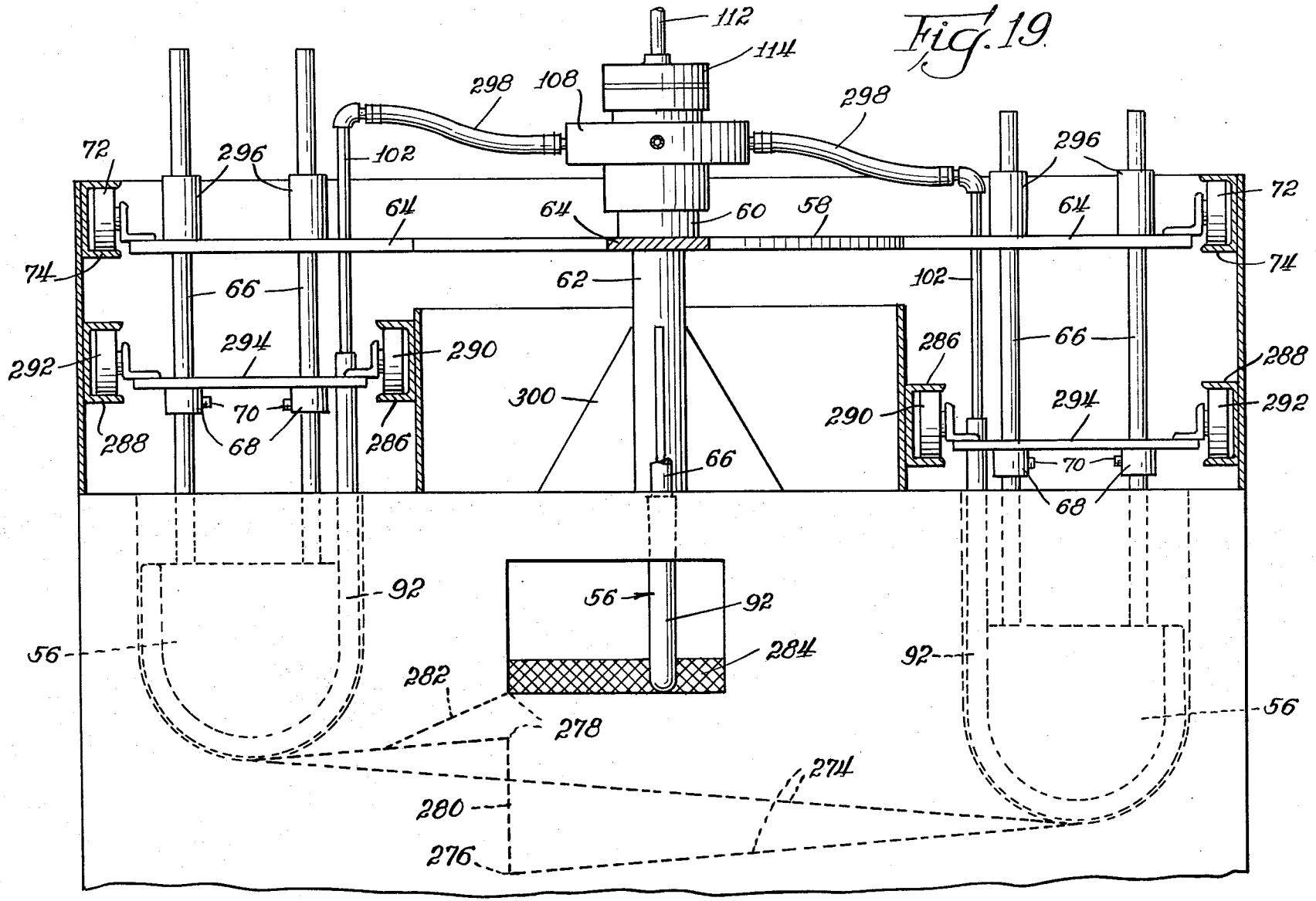
FIG. 19 is a diagramatic view showing a modified form of the invention.

Referring now particularly to FIG. 19, there is shown a modified form of the invention adapted to effect internal separation of the parts to be finished and the finishing material. In this modification, the finishing chamber has a helical rise as indicated by the dotted line 274, gradually rising in the course of 360° from a nadir at 276 to an acme at 278. At that point it drops off sharply along line 280 to the nadir 276. Advantageously, it is a vertical drop.

If desired, the finishing chamber may have a short ramp represented by dotted line 282 leading up to the acme point 278. Extending horizontally from the acme point 278 is a screen 284 of such rise as to separate the loose finishing material from the part or parts to be finished. The loose finishing material drops through the screen to the nadir portion of the finishing chamber and the finished part, or parts, is discharged through a discharge port, not shown, or otherwise removed from the chamber.

Advantageously, the adjacent transverse walls are spaced to straddle the screen, although this is not necessary as long as they straddle the discharge port.

Advantageously, also, the individual chambers are stopped in a position to straddle the discharge port but in the broader aspects of the invention this is not necessary because the separation of the loose finishing material and the discharge of the finished parts can, if desired, be effected while the transverse walls are moving.

When the transverse walls straddle the screen, one will be in close proximity to the acme portion of the finishing chamber and the other will be in close proximity with the nadir portion of the finishing chamber. In such case, it is of advantage to bring at least both said transverse walls into close engagement with said chamber whereby they are in sufficiently close proximity thereto to prevent substantial amounts of loose finishing material in the adjacent individual compartments from passing into the individual compartment or compartments at or adjacent the discharge zone.

When the transverse walls do not straddle the screen, it may be desirable to bring at least the next adjacent wall or walls into close engagement with the finishing chamber whereby they are in sufficiently close proximity thereto to prevent substantial amounts of loose finishing material in the other part of the finishing chamber from passing into the individual compartment or compartments at or adjacent the discharge zone.

In order to keep the transverse walls in close proximity to the walls of the finishing chamber, there is provided means which causes them to rise as the chamber rises, to follow across the screen in close proximity thereto, and to drop down, after the screen has been passed, into close proximity to the inner surface of the finishing chamber at or near the nadir thereof. This is accomplished by providing inner and outer track means 286 and 288, respectively, for guiding rollers 290 and 292 in the same helical path as the chamber. These rollers are connected by transverse or radial bars 294 which are fastened to the rods 66 by means of collar 68 and set screw 70 just as in FIG. 3. Thus, when the transverse walls move along with the contents of the finishing chamber, the same degree of close proximity is maintained between the transverse walls and the inner surface of the finishing chamber throughout except where the separating screen 284 is reached. There the finishing chamber drops abruptly and the transverse walls move along in close proximity to the separating screen 284.

The sprocket 58 with the radial arms 64 is constructed as in FIGS. 2 and 3 except that the rods 66 are free to move up and down with respect to the arms 64 in the guide collars 296. Equivalent parts are designated by the same numbers as in FIGS. 2 and 3. However, since the transverse walls move up and down with respect to the radial arms 64, a flexible tube advantageously connects the pipe 102 with the manifold 108, as shown at 298. Also, since the upstanding trunnion 62 is considerably longer than in FIGS. 2 and 3, it may be desirable to support it with suitable braces 300.

In a preferred modification of the invention, all of the transverse walls are activated to close engagement with the inner surface of the finishing chamber simultaneously, so that when one individual chamber is sealed off, all the individual chambers are sealed off. It is to be understood, however, that as illustrated in FIGS. 2, 4 and 5, the indexing mechanism can be arranged so that only those transverse walls which straddle the discharge opening or port are brought into close engagement with the inner surface of the finishing chamber. It is to be understood, also, that other collapsible tubes like those shown at 154 and 156 of FIGS. 4 and 5 can be provided about the periphery of the annular finishing chamber so that all of the individual chambers are simultaneously sealed off one from the other.

It is to be understood that the invention is not to be limited to the exact details of operation or structure shown and described as obvious modifications and equivalents will be apparent to one skilled in the art.

I claim:

1. Apparatus for treating the surface of parts or workpieces with loose finishing material while maintaining parts isolated from other parts and to prevent damage to parts as a result of collision therebetween, having a resiliently-supported, vibratory finishing chamber in which the workpieces are vibrated with the finishing material, and in which the part-isolating means comprises transverse walls for separating the interior of the finishing chamber into individual compartments, which walls are adapted and arranged for movement along the finishing chamber and are supported for such movement and have edges thereof in close proximity to the walls of said finishing chamber, and further comprising means for relatively moving the edges of at least some of said transverse walls and portions of the interior walls of said finishing chamber into temporary closer proximity to each other, for better isolation of an individual compartment interior of said finishing chamber.

2. Apparatus of claim 1, wherein the walls of at least one individual compartment are brought into closer proximity sufficiently close to prevent passage of substantial amounts of loose finishing material into one individual compartment from adjacent individual compartments.

3. Apparatus of claim 1, wherein said means for effecting closer proximity also constitutes stopping means for stopping movement of said part-isolating means along said finishing chamber.

4. Apparatus of claim 3, wherein said stopping means comprises engaging means for bringing at least two of said transverse walls into close engagement with the inner walls of the finishing chamber.

5. Apparatus of claim 1, including means for timingly activating the closer-proximity means.

6. Apparatus of claim 1, wherein said finishing chamber comprises a discharge zone for discharge of the contents of an individual compartment when said individual compartment is in said discharge zone and wherein said means for effecting closer proximity is adapted to effect said closer proximity of the transverse walls and the interior walls of said finishing chamber when an individual compartment defined by said walls is in said discharge zone.

7. Apparatus of claim 6, wherein said closer proximity is sufficiently close to prevent passage of substantial amounts of loose finishing material from adjacent individual compartments into the individual compartment which is in said discharge zone.

8. Apparatus of claim 6, wherein said finishing chamber comprises discharge means in said discharge zone and wherein adjacent said transverse walls for part-isolation in said finishing chamber are spaced so as to straddle said discharge means for discharge of contents of said compartment disposed between said adjacent transverse walls when said discharge port means is in open or discharge position.

9. Apparatus of claim 8, wherein the means for effecting closer proximity is adapted to effect a close engagement between edges of said transverse walls and the inner walls of said finishing chamber sufficiently close to hold the said compartment with the transverse walls thereof straddling said discharge means.

10. Apparatus of claim 9, wherein the close engagement between edges of said transverse walls and the inner walls of said finishing chamber is sufficiently close to prevent passage of substantial amounts of loose finishing material from adjacent individual compartments into the individual compartment which is in said discharge zone.

11. Apparatus of claim 1, wherein said finishing chamber is annular.

12. Apparatus of claim 1, wherein said finishing chamber has a substantially horizontal arcuate bottom.

13. Apparatus of claim 8 comprising separation means in cooperation with said discharge zone for separation of finished parts from finishing material.

14. Apparatus of claim 13, wherein said separation means is internal of said finishing chamber.

15. Apparatus of claim 14, wherein the bottom of said finishing chamber slopes upwardly to said separation means.

16. Apparatus of claim 15, wherein said finishing chamber is annular and has an arcuate bottom with a helical rise therein rising to said separation means.

17. Apparatus of claim 13, wherein said separation means is external of said finishing chamber.

18. Apparatus of claim 9, including activating means for activating said closer-proximity means into close engagement when the transverse walls of one individual chamber have reached the point in their travel at which they straddle said discharge port.

19. Apparatus of claim 18, wherein the activating means is cocked each time a transverse wall passes a given point and is coupled with timing means for the triggering of said cocked activating means at predetermined time intervals.

20. Apparatus of claim 1, wherein said transverse walls have elastomeric edges apposed to the inner walls of said finishing chamber and adapted to be expanded to bring said edges into closer proximity with the walls of said finishing chamber.

21. Apparatus of claim 20, wherein said expanding means comprises toggle arms adapted to expand said elastomeric edges into closer proximity with the inner walls of said finishing chamber.

22. Apparatus of claim 20, wherein said elastomeric edges are closed tubes and the expanding means comprises means for the introduction of pressure fluid thereinto.

23. Apparatus of claim 6, wherein the closer-proximity means comprises elastomeric means located in the inner walls of said finishing chamber on opposite sides of said discharge means and spaced apart a distance equal to the distance between adjacent said transverse walls, and means for expanding said elastomeric means into juxtaposition to the edges of said transverse walls.

24. Apparatus of claim 23, wherein said elastomeric means are closed tubes and the expanding means comprises means for the introduction of pressure fluid thereinto.

25. Apparatus of claim 1, wherein said finishing chamber has a cross section complementary in shape to that of the transverse walls and of such relative size that in one position the edge portions of said transverse walls are in close proximity with the walls of said discharge zone and in another position are in closer proximity thereto and wherein moving means is provided for moving said transverse walls from the former position to the latter position and vice versa.

26. Apparatus of claim 25, wherein said finishing chamber including said discharge zone is lined with elastomeric material and said transverse walls have edges made of elastomeric material.

27. Apparatus of claim 25, wherein said complementary shape has an outward flare, and the moving means comprises means for lowering said transverse walls to the second named position and raising them to the first named position and vice versa.

28. Apparatus of claim 25, wherein the moving means comprises means for imparting to said transverse walls a rotary motion about the vertical axis simultaneously with a coordinated vertical movement.

29. Apparatus of claim 28, wherein the vertical motion is effected by cam means operative on rotation of the transverse wall associated therewith.

30. Apparatus of claim 25, wherein said moving means comprises means for effecting rotation of said transverse walls about a vertical axis and simultaneously effecting a coordinated rotation thereof about a horizontal axis.

31. Apparatus of claim 25, wherein the complementary shapes of said transverse walls and said finishing chamber are spirals wherein the transverse walls are pivoted at the origin of the spiral and wherein said moving means comprises means for effecting a rotation of said transverse wall about the pivot.

32. Apparatus of claim 1, wherein said finishing chamber has a lining of elastomeric material and said transverse walls have a coating of elastomeric material and the closer-proximity means comprises expanding means for expanding one of said elastomeric liner and said elastomeric coating into closer proximity with the other.

33. Apparatus of claim 32, wherein the expanding means comprises fluid pressure.

34. Apparatus of claim 32, wherein the expanding means comprises laterally movable segments and spreading means for moving them laterally and downwardly.

35. Apparatus of claim 34, wherein the spreading means comprises toggle arms.

36. Apparatus of claim 34, wherein said spreading means comprises a wedge.

37. Apparatus of claim 1, wherein said transverse walls are adapted and arranged to be carried along by the contents of the finishing chamber and are supported for such movement together with the contents of the finishing chamber.

38. Apparatus of claim 1, wherein said transverse walls are supported and adapted for vibration together with said finishing chamber.

39. In a method of treating the surface of parts or workpieces with loose finishing materials while maintaining parts isolated from other parts and to prevent damage to parts as a result of collision therebetween, which comprises the step of vibrating the parts or workpieces and loose finishing material together in a resiliently-supported, vibratory finishing chamber, in which method part-isolating means comprising transverse walls are employed for separating the interior of the finishing chamber into individual compartments, which transverse walls are adapted and arranged for movement along the finishing chamber and have edges in close proximity to the walls of said finishing chamber, the steps which comprise moving said transverse walls along said chamber and moving the edges of at least some of said transverse walls and portions of interior walls of said finishing chamber into temporary relatively closer proximity to each other for better isolation of an individual compartment interior of said finishing chamber.

* * * * *

UNITED STATES PATENT OFFICE

CERTIFICATE OF CORRECTION

Patent No. 4,022,012 Dated May 10, 1977

Inventor(s) Gunther W. Balz

It is certified that error appears in the above-identified patent and that said Letters Patent are hereby corrected as shown below:

Col. 7, Line 65: change "20 in which in" to read --- 20 which in---

Col. 9, Line 5: change "uniflated" to read --- uninflated---

Col. 10, Line 17: change " FIG. 4 and 5" to read --- FIGS. 4 and 5 ---

Col. 13, Line 62: change "of such rise" to read --- of such size---

Col. 18, Line 22: change "finishing materials" to read --- finishing material---

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*